US010170290B2

(12) United States Patent
Remes

(10) Patent No.: US 10,170,290 B2
(45) Date of Patent: Jan. 1, 2019

(54) SYSTEMS AND METHODS FOR GROUPING MS/MS TRANSITIONS

(71) Applicant: Thermo Finnigan LLC, San Jose, CA (US)

(72) Inventor: Philip M. Remes, San Jose, CA (US)

(73) Assignee: THERMO FINNIGAN LLC, San Jose, CA (US)

( * ) Notice: Subject to any disclaimer, the term of this patent is extended or adjusted under 35 U.S.C. 154(b) by 0 days.

(21) Appl. No.: 15/599,274

(22) Filed: May 18, 2017

(65) Prior Publication Data

US 2017/0345631 A1 Nov. 30, 2017

Related U.S. Application Data

(60) Provisional application No. 62/340,806, filed on May 24, 2016.

(51) Int. Cl.
*H01J 49/00* (2006.01)
*H01J 49/42* (2006.01)

(52) U.S. Cl.
CPC ..... *H01J 49/0031* (2013.01); *H01J 49/004* (2013.01); *H01J 49/0045* (2013.01); *H01J 49/4225* (2013.01)

(58) Field of Classification Search
CPC ..... H01J 49/00; H01J 49/02; H01J 49/0027; H01J 49/0031; H01J 49/0045; H01J 49/004; H01J 49/005; H01J 49/26
(Continued)

(56) References Cited

U.S. PATENT DOCUMENTS 5,479,012 A 12/1995 Wells
2012/0043461 A1* 2/2012 Nikolaev ..... H01J 49/4245 250/282

(Continued)

FOREIGN PATENT DOCUMENTS

WO 2010/138781 A2 12/2010
WO 2011/004236 A1 1/2011

(Continued)

OTHER PUBLICATIONS

Percy et al., "Advances in multiplexed MRM-based protein biomarker quantitation toward clinical utility", Biochim. Biophys. Acta (2013), http://dx.doi.org/10.1016/j.bbapap.2013.06.008, pp. 1-10.

(Continued)

*Primary Examiner* — Jason McCormack
(74) *Attorney, Agent, or Firm* — David A. Schell

(57) ABSTRACT

A method for analyzing a sample includes identifying a plurality of precursors for analysis and grouping the precursors into two or more groups. The precursors are grouped such that for the precursors within a group the masses of ions of the precursors in the group are within a first mass range, and the number of precursors within the group is below a maximum allowable number of precursors. The method further includes generating ions from the sample; isolating precursor ions of a group; determining the mass-to-charge ratio of the precursor ions or fragments thereof; and repeating the isolating and determining steps for each group. The method also includes identifying or quantifying the presence of one or more precursors within the sample based on the presence of fragmented ions having a mass-to-charge ratio corresponding to the product ions for the one or more precursors.

15 Claims, 6 Drawing Sheets

(58) Field of Classification Search
USPC ..... 250/281, 282, 283
See application file for complete search history.

(56) References Cited

U.S. PATENT DOCUMENTS

| | | | | |
|---|---|---|---|---|
| 2013/0084645 | A1 | 4/2013 | Coon et al. | |
| 2013/0228678 | A1* | 9/2013 | Savitski ..... | H01J 49/0045 250/282 |
| 2016/0274058 | A1* | 9/2016 | Wildgoose ..... | H01J 49/0031 |
| 2017/0200594 | A1* | 7/2017 | Giles ..... | H01J 49/0009 |

FOREIGN PATENT DOCUMENTS

| | | | |
|---|---|---|---|
| WO | 2011/106768 | A1 | 9/2011 |
| WO | 2013/150351 | A1 | 10/2013 |

OTHER PUBLICATIONS

Soni, et al., "Selective Injection and Isolation of Ions in Quadrupole Ion Trap Mass Spectrometry Using Notched Waveforms Created Using the Inverse Fourier Transform," Analytical Chemistry, vol. 66, No. 15, 1994, pp. 2488-2496.
Zhang et al., "The Use of Variable Q1 Isolation Windows Improves Selectivity in LC-SWATH-MS Acquisition", J. Proteome Res. 2015, 14, pp. 4359-4371.

* cited by examiner

SYSTEMS AND METHODS FOR GROUPING MS/MS TRANSITIONS

FIELD

The present disclosure generally relates to the field of mass spectrometry including systems and methods for grouping MS/MS transitions.

INTRODUCTION

Tandem mass spectrometry, referred to as MS/MS, is a popular and widely-used analytical technique whereby precursor ions derived from a sample are subjected to fragmentation under controlled conditions to produce product ions. The product ion spectra contain information that is useful for structural elucidation and for identification of sample components with high specificity. In a typical MS/MS experiment, a relatively small number of precursor ion species are selected for fragmentation, for example those ion species of greatest abundances or those having mass-to-charge ratios (m/z's) matching values in an inclusion list.

Traditional MS/MS analyses isolate only one precursor ion at a time, while discarding all other ions. Thus while instruments may approach 100% duty cycle of sampling some precursor, the overall efficiency of sampling is on the order of 0.1% (e.g. 1 Th isolation window for a 1000 Th mass range). Multiplexing can increase the sampling efficiency. One simple method of multiplexing increases the size of the isolation windows. The sampling efficiency is clearly increased with this method, at the cost of decreased specificity and increased computational complexity, as the provenance of the MS/MS fragment ions becomes difficult to determine. With hybrid instruments such as Q-TOF instrument and Q-ORBITRAP instrument, multiple precursors can be successively sampled with the quadrupole mass filter (QMF), and their MS/MS products simultaneously sampled with the second mass analyzer. This method maximizes the utilization of the second analyzer, but does not actually increase sampling efficiency, since still only one precursor is selected at a time. From the foregoing it will be appreciated that a need exists for improved methods for tandem mass spectrometry.

SUMMARY

In a first aspect, a method for analyzing a sample can include identifying a plurality of precursors for analysis, and grouping the precursors into two or more groups. The precursors can be grouped according to at least the following criteria: a) masses of ions of the precursors in the group are within a first mass range; b) masses of product ions of the precursors in the group are within a second mass range; c) the number of precursors within the group is below a maximum allowable number of precursors; and d) each precursor within the group has at least one unique product ion that differs from the product ions of all the other precursors within the group. The method can further include generating ions from the sample; isolating precursor ions of a group; fragmenting the ions of the group; determining the mass-to-charge ratio of the fragment ions; and repeating the isolating, fragmenting, and determining steps for the two or more groups. Additionally, the method can include identifying or quantifying the presence of one or more precursors within the sample based on the presence of fragmented ions having a mass-to-charge ratio corresponding to the unique product ion for the precursor.

In various embodiments of the first aspect, the ions of the group can be fragmented substantially simultaneously. In other embodiments of the first aspect, the ions of the group are fragmented sequentially.

In various embodiments of the first aspect, the precursors can be grouped according to an additional criterion that the optimum fragmentation energies for the precursors within the group are within a fragmentation energy range.

In various embodiments of the first aspect, identifying the plurality of precursors can include performing a survey scan to identifying ions within the sample.

In various embodiments of the first aspect, isolating the precursor ions can include isolating the precursor ions using a quadrupole ion trap, a quadrupole mass filter, or an ion cyclotron resonance device.

In various embodiments of the first aspect, isolating the precursor ions can include applying a multi-notch isolation waveform.

In various embodiments of the first aspect, the method can further include separating components of the sample by chromatography prior to generating ions. The precursors can be grouped according to an additional criterion that the retention times for the precursors within a group are within a precursor time range.

In various embodiments of the first aspect, the precursors can be grouped according to an additional criterion that the intensity of the precursor ions within a group is within an intensity factor range.

In a second aspect, a mass spectrometer can include an ion source; a radio frequency ion trap; a fragmentation cell; a mass analyzer; and a controller. The controller can be configured to identify a plurality of precursors for analysis and group the precursors into two or more groups. The controller can be configured to group the precursors according to at least the following criteria: a) masses of ions of the precursors in the group are within a first mass range; b) masses of product ions of the precursors in the group are within a second mass range; c) the number of precursors within the group is below a maximum allowable number of precursors; and d) each precursor within the group has at least one unique product ion that differs from the product ions of all the other precursors within the group. The controller can be further configured to cause the generation of ions from the sample using the ion source; cause the isolation of precursor ions of a group using the radio frequency ion trap; cause the fragment the ions of the group by subjecting the ions within the fragmentation cell to a fragmentation energy; and determine the mass-to-charge ratio of the fragment ions. The controller can be further configured to repeat the isolate, fragment, and determine steps for additional groups; and identify or quantify the presence of one or more precursors within the sample based on the presence of fragmented ions having a mass-to-charge ratio corresponding to the unique product ion for the precursor.

In various embodiments of the second aspect, the ions of the group can be fragmented substantially simultaneously.

In various embodiments of the second aspect, the controller can be configured to group the precursors according to at least one additional criterion selected from the group consisting of: 1) the retention time for the precursors within the group are within a precursor time range; 2) the intensity of the precursor ions is within an intensity factor range; and 3) the optimum fragmentation energies for the precursors within the group are within an energy range.

In various embodiments of the second aspect, the controller can be configured to perform a survey scan of the sample to identify the plurality of precursors.

In various embodiments of the second aspect, the radio frequency ion trap can be a quadrupole ion trap.

In various embodiments of the second aspect, the controller can be configured to cause the isolation of the precursor ions by applying a multi-notch isolation waveform to the quadrupole ion trap.

In a third aspect, a method for analyzing a sample can include identifying a plurality of precursors for analysis; and grouping the precursors into two or more groups. The precursors can be grouped according at least the following criteria: a) masses of ions of the precursors in the group are within a first mass range; and b) the number of precursors within the group is below a maximum allowable number of precursors. The method can further include generating ions from the sample; isolating precursor ions of a group; and determining the mass-to-charge ratio of the precursor ions or fragments thereof. Additionally, the method can include repeating the isolating and determining steps for additional groups; and identifying or quantifying the presence of one or more precursors within the sample based on the presence of fragmented ions having a mass-to-charge ratio corresponding to the product ions for the one or more precursors.

In various embodiments of the third aspect, the ions of the group can be fragmented substantially simultaneously.

In various embodiments of the third aspect, the method can further include fragmenting the ions of the group.

In various embodiments of the third aspect, isolating the precursor ions can include isolating the precursor ions using a quadrupole ion trap, a quadrupole mass filter, or an ion cyclotron resonance device.

In various embodiments of the third aspect, the precursors can be grouped according to at least one additional criterion selected from the group consisting of: 1) the intensity of the precursor ions is within an intensity factor range; 2) masses of product ions of the precursors in the group are within a second mass range; 3) the optimum fragmentation energies for the precursors within the group are within an energy range; 4) each precursor within the group has at least one unique product ion that differs from the product ions of all the other precursors within the group; and 5) the retention time for the precursors within the group are within a precursor time range.

DRAWINGS

For a more complete understanding of the principles disclosed herein, and the advantages thereof, reference is now made to the following descriptions taken in conjunction with the accompanying drawings, in which.

Figure 1:
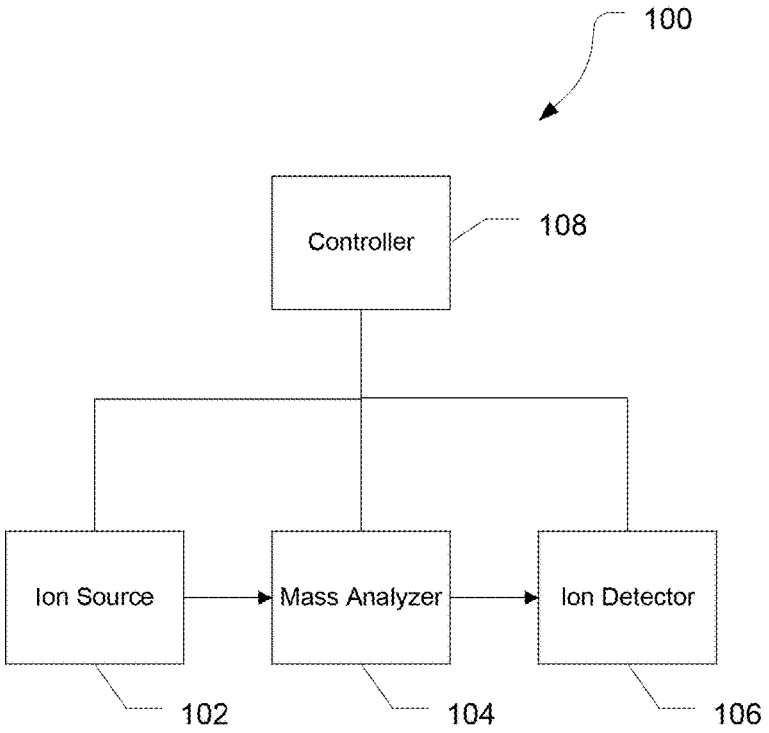
FIG. 1 is a block diagram of an exemplary mass spectrometry system, in accordance with various embodiments.

It is to be understood that the figures are not necessarily drawn to scale, nor are the objects in the figures necessarily drawn to scale in relationship to one another. The figures are depictions that are intended to bring clarity and understanding to various embodiments of apparatuses, systems, and methods disclosed herein. Wherever possible, the same reference numbers will be used throughout the drawings to refer to the same or like parts. Moreover, it should be appreciated that the drawings are not intended to limit the scope of the present teachings in any way.

DESCRIPTION OF VARIOUS EMBODIMENTS

Embodiments of systems and methods for ion isolation are described herein and in the accompanying exhibits.

The section headings used herein are for organizational purposes only and are not to be construed as limiting the described subject matter in any way.

In this detailed description of the various embodiments, for purposes of explanation, numerous specific details are set forth to provide a thorough understanding of the embodiments disclosed. One skilled in the art will appreciate, however, that these various embodiments may be practiced with or without these specific details. In other instances, structures and devices are shown in block diagram form. Furthermore, one skilled in the art can readily appreciate that the specific sequences in which methods are presented and performed are illustrative and it is contemplated that the sequences can be varied and still remain within the spirit and scope of the various embodiments disclosed herein.

All literature and similar materials cited in this application, including but not limited to, patents, patent applications, articles, books, treatises, and internet web pages are expressly incorporated by reference in their entirety for any purpose. Unless described otherwise, all technical and scientific terms used herein have a meaning as is commonly understood by one of ordinary skill in the art to which the various embodiments described herein belongs.

It will be appreciated that there is an implied "about" prior to the temperatures, concentrations, times, pressures, flow rates, cross-sectional areas, etc. discussed in the present teachings, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting. It is to be understood that both the foregoing general description and the following detailed description are exemplary and explanatory only and are not restrictive of the present teachings.

As used herein, "a" or "an" also may refer to "at least one" or "one or more." Also, the use of "or" is inclusive, such that the phrase "A or B" is true when "A" is true, "B" is true, or both "A" and "B" are true. Further, unless otherwise required by context, singular terms shall include pluralities and plural terms shall include the singular.

A "system" sets forth a set of components, real or abstract, comprising a whole where each component interacts with or is related to at least one other component within the whole.

Mass Spectrometry Platforms

Various embodiments of mass spectrometry platform 100 can include components as displayed in the block diagram of FIG. 1. In various embodiments, elements of FIG. 1 can be incorporated into mass spectrometry platform 100. According to various embodiments, mass spectrometer 100 can include an ion source 102, a mass analyzer 104, an ion detector 106, and a controller 108.

In various embodiments, the ion source 102 generates a plurality of ions from a sample. The ion source can include, but is not limited to, a matrix assisted laser desorption/ionization (MALDI) source, electrospray ionization (ESI) source, atmospheric pressure chemical ionization (APCI) source, atmospheric pressure photoionization source (APPI), inductively coupled plasma (ICP) source, electron ionization source, chemical ionization source, photoionization source, glow discharge ionization source, thermospray ionization source, and the like.

In various embodiments, the mass analyzer 104 can separate ions based on a mass to charge ratio of the ions. For example, the mass analyzer 104 can include a quadrupole mass filter analyzer, a quadrupole ion trap analyzer, a time-of-flight (TOF) analyzer, an electrostatic trap (e.g., ORBITRAP) mass analyzer, Fourier transforms ion cyclotron resonance (FT-ICR) mass analyzer, and the like. In various embodiments, the mass analyzer 104 can also be configured to fragment the ions using collision induced dissociation (CID) electron transfer dissociation (ETD), electron capture dissociation (ECD), photo induced dissociation (PID), surface induced dissociation (SID), and the like, and further separate the fragmented ions based on the mass-to-charge ratio.

In various embodiments, the ion detector 106 can detect ions. For example, the ion detector 106 can include an electron multiplier, a Faraday cup, and the like. Ions leaving the mass analyzer can be detected by the ion detector. In various embodiments, the ion detector can be quantitative, such that an accurate count of the ions can be determined.

In various embodiments, the controller 108 can communicate with the ion source 102, the mass analyzer 104, and the ion detector 106. For example, the controller 108 can configure the ion source or enable/disable the ion source. Additionally, the controller 108 can configure the mass analyzer 104 to select a particular mass range to detect. Further, the controller 108 can adjust the sensitivity of the ion detector 106, such as by adjusting the gain. Additionally, the controller 108 can adjust the polarity of the ion detector 106 based on the polarity of the ions being detected. For example, the ion detector 106 can be configured to detect positive ions or be configured to detected negative ions.

Grouping Transitions

Multiple precursor selection using arbitrary waveform isolation is a multiplexing method that can offers significant advantages. Multiple precursors can be isolated from the rest of the sample simultaneously with high specificity (1-2 Th). The sampling efficiency can be increased linearly by the number of precursors selected. The multiple precursors can be fragmented to form diagnostic MS/MS fragment ions, which can further increase the specificity of analysis. However to realize the full potential of this, or any multiplexing technique, the precursors which are selected for simultaneous analysis should be chosen judiciously, accounting for the detailed performance characteristics of the multiplexed isolation, fragmentation, and the final mass analysis. The disclosed method for grouping precursors, which can be used for targeted analyses, where the precursor-to-product ion transitions are known a priori, or for data dependent analyses, where this knowledge is initially missing.

Multiplexed precursor isolation using broadband arbitrary waveform isolation was demonstrated by Cooks and coworkers more than two decades ago (Analytical Chemistry, Vol. 66, pg. 2488, 1994). Since 2012, this technique has been marketed under the term Synchronous Precursor Selection (SPS) by Thermo Fisher Scientific, but has only been broadly used in the narrow application of MS3 protein quantitation using isotopically labeled peptide mass tags. To be useful for general MS2 level analyses, the characteristics of multiple precursor selection need to be considered in detail.

In various embodiments, high isolation efficiency can only be maintained for a certain mass range, for example 2-4× and precursor ions within a group may be limited to precursors within that mass range. Similarly, it can be desirable to ensure fragment ions are within a mass range so that they can be efficiently maintained within the trap during fragmentation. Additionally, the mass range of the downstream ion optics and/or mass analyzer may place limitations on the range of fragment ion masses.

Computational complexity of analyzing the fragment data can increase with the total number of precursors and/or fragments being analyzed. In various embodiments, the total number of precursors per group can be limited to ensure the analysis can be performed in a reasonable time. Additionally, in some embodiments, ensuring that the precursors in a group each have a fragment ion that is unique to the group can further reduce computational complexity. In other embodiments, however, a compound may produce a number of precursor ions that differ only by a simple modification and produce a substantially similar set of fragment ions. In such cases, it may be desirable to group these ions for analysis even though it is unlikely that there are unique fragment ions for the precursor ions.

In various embodiments, components of a sample may be separated by chromatography, such as liquid chromatograph or gas chromatography, prior to being ionized by the mass spectrometer, and grouping precursors such that their retention times are within a retention time range can be desirable.

The energy required to sufficiently and efficiently fragment precursor ions can differ depending on various characteristics of the precursor ions and the fragmentation method used. In various embodiments, in can be desirable to ensure the optimum fragmentation energies for the precursors within a group are within a fragmentation energy range.

Differing concentrations of precursor compounds in the sample and differences in ionization efficiency for the precursor compounds can lead to different ion intensities for the precursor compounds. To ensure adequate signal from the lower intensity precursor while the higher intensity precursor does not saturate the mass analyzer or detector, it can be desirable to limit the precursors within a group to precursors within an intensity factor range, such as based on the dynamic range of the mass analyzer or detector.

Figure 2:
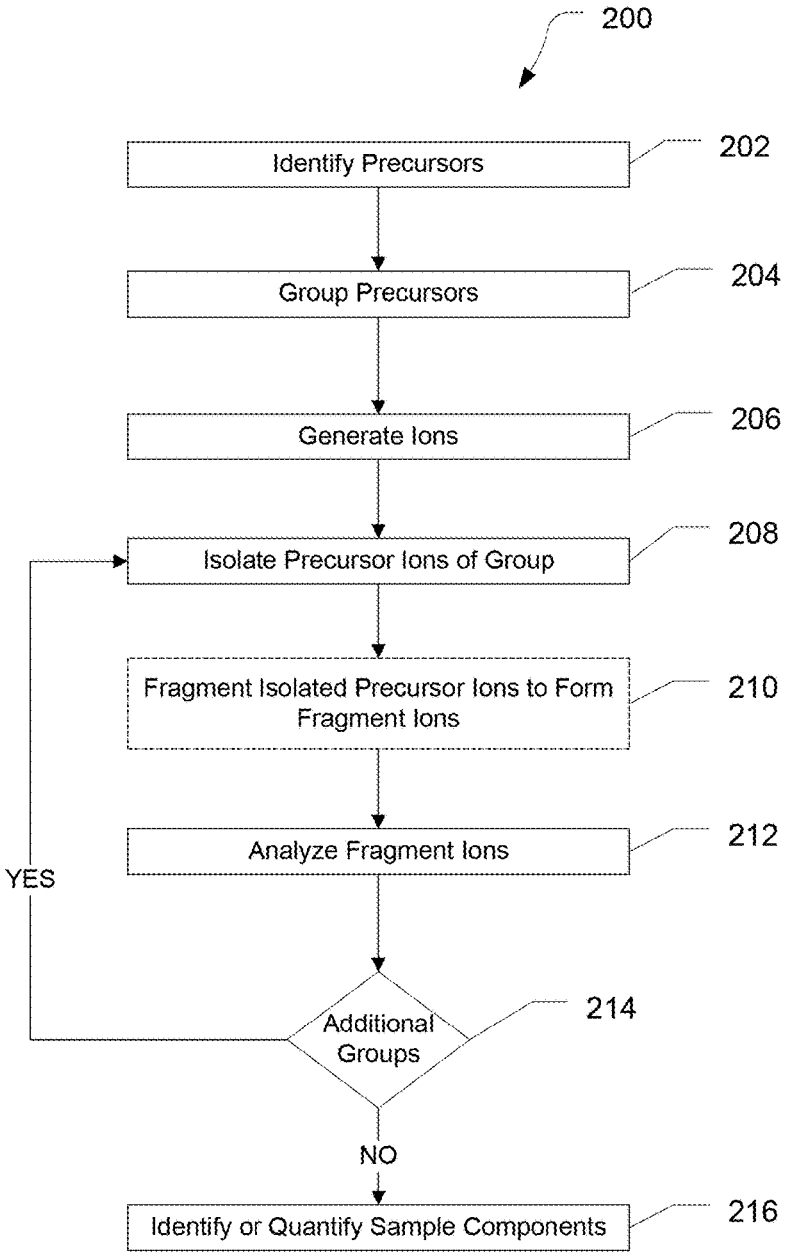
FIG. 2 is a flow diagram illustrating an exemplary method for grouping transitions, in accordance with various embodiments.

FIG. 2 is a flow diagram of an exemplary method 200 of isolating and subsequently analyzing the isolated ions. At 202, precursors can be identified. In various embodiments, such as when performing a targeted analysis, the precursor-to-product ion transitions can be provided by a user. In other embodiments, a survey scan can be conducted to identify precursors and/or fragments when the knowledge about the precursors/fragments is initially missing.

At 204, the precursors can be grouped. In various embodiments, the precursors can be group according to selection criteria. The selection criteria can include 1) masses of ions of the precursors in the group are within a first mass range; 2) masses of product ions of the precursors in the group are within a second mass range; 3) the number of precursors within the group is below a maximum allowable number of precursors; 4) each precursor within the group has at least one unique product ion that differs from the product ions of all the other precursors within the group; 5) the retention time for the precursors within the group are within a precursor time range; 6) the intensity of the precursor ions is within an intensity factor range; 7) the optimum fragmentation energies for the precursors within the group are within an energy range; or any combination thereof.

In particular embodiments, such as when the precursors are different analytes and MS/MS analysis is being performed, the selection criteria can include at least 1) masses of ions of the precursors in the group are within a first mass range; 2) masses of product ions of the precursors in the group are within a second mass range; 3) the number of precursors within the group is below a maximum allowable number of precursors; and 4) each precursor within the group has at least one unique product ion that differs from the product ions of all the other precursors within the group.

In other embodiments, such as when the precursors differ only by a simple chemical modification such as the number of type of chemical adduct, the selection criteria can include at least 1) masses of ions or the precursors in the group are within a first mass range; 2) masses of product ions of the precursors in the group are within a second mass range; and 3) the number of precursors within the group is below a maximum allowable number of precursors.

In yet other embodiments, when performing a selected ion monitoring experiment, the selection criteria can include at least 1) masses of ions of the precursors in the group are within a first mass range and 3) the number of precursors within the group is below a maximum allowable number of precursors.

At 206, ions are generated from a sample. In various embodiments, the sample can be provided by a gas chromatograph, a liquid chromatograph, direct application, or other means of supplying a sample to a mass spectrometer. When using a gas chromatograph or a liquid chromatograph, components of the sample can be separated base on retention time prior to reaching the mass spectrometer and ions being generated. The sample may be ionized by various methods including but not limited to MALDI, ESI, APCI, APPI, ICP, electron ionization, chemical ionization, photoionization, glow discharge ionization, thermospray ionization, and the like.

At 208, precursor ions of a group can be isolated from other ions. The ions can be isolated in a radio frequency ion trap, such as a quadrupole ion trap or a 3D ion trap, a quadrupole mass filter, an ion cyclotron resonance device, or other mass selective device. The precursor ions can be isolated using a multi-notch isolation waveform.

At 210, the precursor ions can optionally be fragmented, such as by collision-induced dissociation (CID), electron-capture dissociation (ECD), electron-transfer dissociation (ETD), negative electron-transfer dissociation (NETD), electron-detachment dissociation (EDD), photodissociation, particularly infrared multiphoton dissociation (IRMPD) and blackbody infrared radiative dissociation (BIRD), surface-induced dissociation (SID), Higher-energy C-trap dissociation (HCD), charge remote fragmentation, and the like. In various embodiments, the precursor ions of a group can be fragmented substantially simultaneously. Alternatively, the precursor ions can be fragmented sequentially.

At 212, the precursor ions or fragments thereof can be analyzed to determine their mass-to-charge ratio. The ions can be analyzed using a quadrupole mass filter analyzer, a quadrupole ion trap analyzer, a time-of-flight (TOF) analyzer, an electrostatic trap (e.g., ORBITRAP) mass analyzer, Fourier transforms ion cyclotron resonance (FT-ICR) mass analyzer, and the like.

At 214, when additional groups of precursor ions need to be analyzed, they system can return to 208 to isolate the next group of precursor ions. Alternatively, when there are no additional groups of precursor ions to be analyzed, the system can identify or quantify sample components, such as at least in part based on the mass-to-charge ratio of the precursor ions or fragments thereof.

Computer-Implemented System

Figure 3:
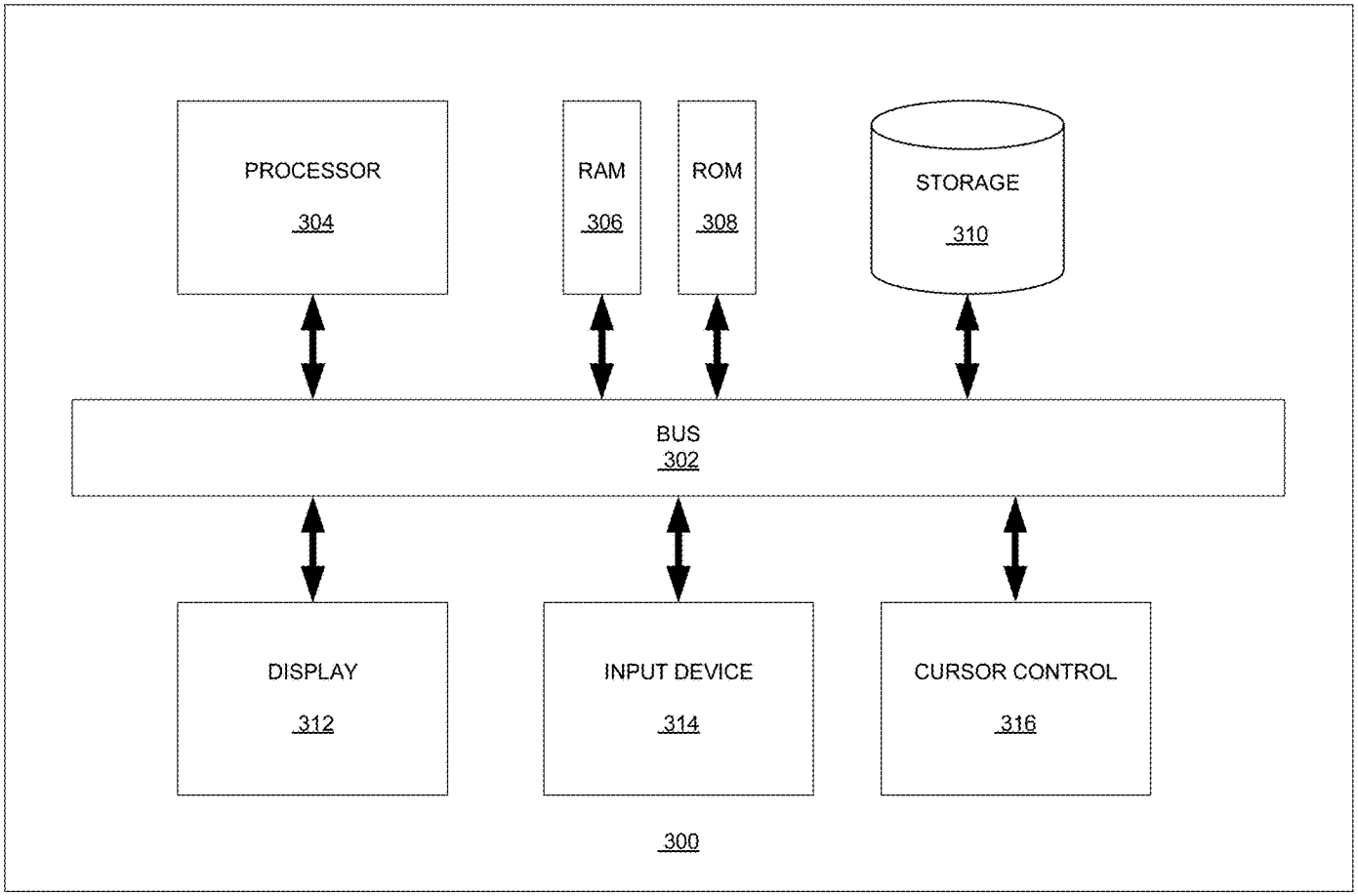
FIG. 3 is a block diagram illustrating an exemplary computer system.

FIG. 3 is a block diagram that illustrates a computer system 300, upon which embodiments of the present teachings may be implemented as which may incorporate or communicate with a system controller, for example controller 108 shown in FIG. 1, such that the operation of components of the associated mass spectrometer may be adjusted in accordance with calculations or determinations made by computer system 300. In various embodiments, computer system 300 can include a bus 302 or other communication mechanism for communicating information, and a processor 304 coupled with bus 302 for processing information. In various embodiments, computer system 300 can also include a memory 306, which can be a random access memory (RAM) or other dynamic storage device, coupled to bus 302, and instructions to be executed by processor 304. Memory 306 also can be used for storing temporary variables or other intermediate information during execution of instructions to be executed by processor 304. In various embodiments, computer system 300 can further include a read only memory (ROM) 308 or other static storage device coupled to bus 302 for storing static information and instructions for processor 304. A storage device 310, such as a magnetic disk or optical disk, can be provided and coupled to bus 302 for storing information and instructions.

In various embodiments, processor 304 can include a plurality of logic gates. The logic gates can include AND gates, OR gates, NOT gates, NAND gates, NOR gates, EXOR gates, EXNOR gates, or any combination thereof. An AND gate can produce a high output only if all the inputs are high. An OR gate can produce a high output if one or more of the inputs are high. A NOT gate can produce an inverted version of the input as an output, such as outputting a high value when the input is low. A NAND (NOT-AND) gate can produce an inverted AND output, such that the output will be high if any of the inputs are low. A NOR (NOT-OR) gate can produce an inverted OR output, such that the NOR gate output is low if any of the inputs are high. An EXOR (Exclusive-OR) gate can produce a high output if either, but not both, inputs are high. An EXNOR (Exclusive-NOR) gate can produce an inverted EXOR output, such that the output is low if either, but not both, inputs are high.

TABLE 1

Logic Gates Truth Table

| INPUTS | | OUTPUTS | | | | | | |
|---|---|---|---|---|---|---|---|---|
| A | B | NOT A | AND | NAND | OR | NOR | EXOR | EXNOR |
| 0 | 0 | 1 | 0 | 1 | 0 | 1 | 0 | 1 |
| 0 | 1 | 1 | 0 | 1 | 1 | 0 | 1 | 0 |

TABLE 1-continued

| Logic Gates Truth Table | | | | | | | | |
|---|---|---|---|---|---|---|---|---|
| INPUTS | | OUTPUTS | | | | | | |
| A | B | NOT A | AND | NAND | OR | NOR | EXOR | EXNOR |
| 1 | 0 | 0 | 0 | 1 | 1 | 0 | 1 | 0 |
| 1 | 1 | 0 | 1 | 0 | 1 | 0 | 0 | 1 |

One of skill in the art would appreciate that the logic gates can be used in various combinations to perform comparisons, arithmetic operations, and the like. Further, one of skill in the art would appreciate how to sequence the use of various combinations of logic gates to perform complex processes, such as the processes described herein.

In an example, a 1-bit binary comparison can be performed using a XNOR gate since the result is high only when the two inputs are the same. A comparison of two multi-bit values can be performed by using multiple XNOR gates to compare each pair of bits, and the combining the output of the XNOR gates using and AND gates, such that the result can be true only when each pair of bits have the same value. If any pair of bits does not have the same value, the result of the corresponding XNOR gate can be low, and the output of the AND gate receiving the low input can be low.

In another example, a 1-bit adder can be implemented using a combination of AND gates and XOR gates. Specifically, the 1-bit adder can receive three inputs, the two bits to be added (A and B) and a carry bit (Cin), and two outputs, the sum (S) and a carry out bit (Cout). The Cin bit can be set to 0 for addition of two one bit values, or can be used to couple multiple 1-bit adders together to add two multi-bit values by receiving the Cout from a lower order adder. In an exemplary embodiment, S can be implemented by applying the A and B inputs to a XOR gate, and then applying the result and Cin to another XOR gate. Cout can be implemented by applying the A and B inputs to an AND gate, the result of the A-B XOR from the SUM and the Cin to another AND, and applying the input of the AND gates to a XOR gate.

TABLE 2

| 1-bit Adder Truth Table | | | | |
|---|---|---|---|---|
| INPUTS | | | OUTPUTS | |
| A | B | Cin | S | Cout |
| 0 | 0 | 0 | 0 | 0 |
| 1 | 0 | 0 | 0 | 1 |
| 0 | 1 | 0 | 0 | 1 |
| 1 | 1 | 0 | 1 | 0 |
| 0 | 0 | 1 | 0 | 1 |
| 1 | 0 | 1 | 1 | 0 |
| 0 | 1 | 1 | 1 | 0 |
| 1 | 1 | 1 | 1 | 1 |

In various embodiments, computer system 300 can be coupled via bus 302 to a display 312, such as a cathode ray tube (CRT) or liquid crystal display (LCD), for displaying information to a computer user. An input device 314, including alphanumeric and other keys, can be coupled to bus 302 for communicating information and command selections to processor 304. Another type of user input device is a cursor control 316, such as a mouse, a trackball or cursor direction keys for communicating direction information and command selections to processor 304 and for controlling cursor movement on display 312. This input device typically has two degrees of freedom in two axes, a first axis (i.e., x) and a second axis (i.e., y), that allows the device to specify positions in a plane.

A computer system 300 can perform the present teachings. Consistent with certain implementations of the present teachings, results can be provided by computer system 300 in response to processor 304 executing one or more sequences of one or more instructions contained in memory 306. Such instructions can be read into memory 306 from another computer-readable medium, such as storage device 310. Execution of the sequences of instructions contained in memory 306 can cause processor 304 to perform the processes described herein. In various embodiments, instructions in the memory can sequence the use of various combinations of logic gates available within the processor to perform the processes describe herein. Alternatively hard-wired circuitry can be used in place of or in combination with software instructions to implement the present teachings. In various embodiments, the hard-wired circuitry can include the necessary logic gates, operated in the necessary sequence to perform the processes described herein. Thus implementations of the present teachings are not limited to any specific combination of hardware circuitry and software.

The term "computer-readable medium" as used herein refers to any media that participates in providing instructions to processor 304 for execution. Such a medium can take many forms, including but not limited to, non-volatile media, volatile media, and transmission media. Examples of non-volatile media can include, but are not limited to, optical or magnetic disks, such as storage device 310. Examples of volatile media can include, but are not limited to, dynamic memory, such as memory 306. Examples of transmission media can include, but are not limited to, coaxial cables, copper wire, and fiber optics, including the wires that comprise bus 302.

Common forms of non-transitory computer-readable media include, for example, a floppy disk, a flexible disk, hard disk, magnetic tape, or any other magnetic medium, a CD-ROM, any other optical medium, punch cards, paper tape, any other physical medium with patterns of holes, a RAM, PROM, and EPROM, a FLASH-EPROM, any other memory chip or cartridge, or any other tangible medium from which a computer can read.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

In various embodiments, the methods of the present teachings may be implemented in a software program and applications written in conventional programming languages such as C, C++, etc.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

The embodiments described herein, can be practiced with other computer system configurations including hand-held devices, microprocessor systems, microprocessor-based or programmable consumer electronics, minicomputers, mainframe computers and the like. The embodiments can also be practiced in distributing computing environments where tasks are performed by remote processing devices that are linked through a network.

It should also be understood that the embodiments described herein can employ various computer-implemented operations involving data stored in computer systems. These operations are those requiring physical manipulation of physical quantities. Usually, though not necessarily, these quantities take the form of electrical or magnetic signals capable of being stored, transferred, combined, compared, and otherwise manipulated. Further, the manipulations performed are often referred to in terms, such as producing, identifying, determining, or comparing.

Any of the operations that form part of the embodiments described herein are useful machine operations. The embodiments, described herein, also relate to a device or an apparatus for performing these operations. The systems and methods described herein can be specially constructed for the required purposes or it may be a general purpose computer selectively activated or configured by a computer program stored in the computer. In particular, various general purpose machines may be used with computer programs written in accordance with the teachings herein, or it may be more convenient to construct a more specialized apparatus to perform the required operations.

Certain embodiments can also be embodied as computer readable code on a computer readable medium. The computer readable medium is any data storage device that can store data, which can thereafter be read by a computer system. Examples of the computer readable medium include hard drives, network attached storage (NAS), read-only memory, random-access memory, CD-ROMs, CD-Rs, CD-RWs, magnetic tapes, and other optical and non-optical data storage devices. The computer readable medium can also be distributed over a network coupled computer systems so that the computer readable code is stored and executed in a distributed fashion.

Results

A set of 84 transitions (shown in Table 1) from a targeted selected reaction monitoring (SRM) assay are monitored.

TABLE 1

| Precursor (m/z) | Product (m/z) |
|---|---|
| 76.14 | 30.271 |
| 76.14 | 48.16 |
| 76.14 | 58.174 |
| 90.05 | 42.16 |
| 90.05 | 44.222 |

TABLE 1-continued

| Precursor (m/z) | Product (m/z) |
|---|---|
| 90.05 | 62.174 |
| 177.1 | 80.111 |
| 177.1 | 98.111 |
| 177.1 | 146.111 |
| 216.048 | 96.111 |
| 216.048 | 104.062 |
| 216.048 | 174.111 |
| 231.1 | 115.236 |
| 231.1 | 170.111 |
| 231.1 | 185.111 |
| 240.16 | 148.111 |
| 240.16 | 166.111 |
| 240.16 | 222.236 |
| 267.232 | 145.111 |
| 267.232 | 190.111 |
| 267.232 | 225.111 |
| 271.06 | 140.062 |
| 271.06 | 165.062 |
| 271.06 | 208.111 |
| 271.11 | 91.111 |
| 271.11 | 155.062 |
| 271.11 | 172.062 |
| 289.182 | 70.111 |
| 289.182 | 125.049 |
| 289.182 | 151.111 |
| 289.22 | 97.174 |
| 289.22 | 109.111 |
| 289.22 | 253.222 |
| 309.09 | 205.111 |
| 309.09 | 274.111 |
| 309.09 | 281.062 |
| 309.172 | 163.125 |
| 309.172 | 173.062 |
| 309.172 | 251.062 |
| 310.262 | 201.111 |
| 310.262 | 236.174 |
| 310.262 | 254.174 |
| 528.205 | 203.062 |
| 528.205 | 249.062 |
| 528.205 | 293.062 |
| 531.285 | 82.174 |
| 531.285 | 244.062 |
| 531.285 | 489.236 |
| 602.22 | 468.06 |
| 602.22 | 510.444 |
| 602.22 | 546.028 |
| 625.955 | 127.111 |
| 625.955 | 217.951 |
| 625.955 | 372.84 |
| 662.985 | 264.062 |
| 662.985 | 372.84 |
| 662.985 | 635.889 |
| 1202.985 | 224.222 |
| 1202.985 | 425.396 |
| 1202.985 | 1184.951 |
| 231.112 | 42.222 |
| 231.112 | 188.049 |
| 231.112 | 230.556 |
| 237.162 | 42.222 |
| 237.162 | 85.049 |
| 237.162 | 194.111 |
| 269.1 | 79.049 |
| 269.1 | 106.111 |
| 269.1 | 170.062 |
| 294.062 | 178.111 |
| 294.062 | 214.049 |
| 294.062 | 250.062 |
| 307.162 | 117.049 |
| 307.162 | 161.062 |
| 307.162 | 250.174 |
| 321.062 | 152.111 |
| 321.062 | 194.049 |
| 321.062 | 257.062 |
| 329.062 | 77.986 |
| 329.062 | 205 |
| 329.062 | 285 |

TABLE 1-continued

| Precursor (m/z) | Product (m/z) |
|---|---|
| 623.872 | 126.938 |
| 623.872 | 344.889 |
| 623.872 | 512.903 |

A traditional analysis with a triple quadrupole instrument will analyze each of these transitions separately and sequentially. An analysis with full product ion scanning capability, such as that afforded by a quadrupole ion trap mass spectrometer (QIT), is able to take advantage of the specificity afforded by MS/MS to analyze these 84 transitions in much fewer scans. Table 2 shows how these transitions can be grouped into just 8 scans, using N=4 multiplexed isolation windows of 2ε=2 Th width.

TABLE 2

| Precursor (m/z) | Product (m/z) |
|---|---|
| Group 1 | |
| 76.14 | 30.271 |
| 76.14 | 48.16 |
| 76.14 | 58.174 |
| 90.05 | 42.16 |
| 90.05 | 44.222 |
| 90.05 | 62.174 |
| Group 2 | |
| 177.1 | 80.111 |
| 177.1 | 98.111 |
| 177.1 | 146.111 |
| 216.048 | 96.111 |
| 216.048 | 104.062 |
| 216.048 | 174.111 |
| 231.1 | 115.236 |
| 231.1 | 170.111 |
| 231.1 | 185.111 |
| 240.16 | 148.111 |
| 240.16 | 166.111 |
| 240.16 | 222.236 |
| 231.112 | 42.222 |
| 231.112 | 188.049 |
| 231.112 | 230.556 |
| Group 3 | |
| 267.232 | 145.111 |
| 267.232 | 190.111 |
| 267.232 | 225.111 |
| 271.06 | 140.062 |
| 271.06 | 165.062 |
| 271.06 | 208.111 |
| 271.11 | 91.111 |
| 271.11 | 155.062 |
| 271.11 | 172.062 |
| 289.182 | 70.111 |
| 289.182 | 125.049 |
| 289.182 | 151.111 |
| 289.22 | 97.174 |
| 289.22 | 109.111 |
| 289.22 | 253.222 |
| 309.09 | 205.111 |
| 309.09 | 274.111 |
| 309.09 | 281.062 |
| 309.172 | 163.125 |
| 309.172 | 173.062 |
| 309.172 | 251.062 |
| Group 4 | |
| 310.262 | 201.111 |
| 310.262 | 236.174 |
| 310.262 | 254.174 |
| 237.162 | 42.222 |
| 237.162 | 85.049 |
| 237.162 | 194.111 |
| 269.1 | 79.049 |

TABLE 2-continued

| Precursor (m/z) | Product (m/z) |
|---|---|
| 269.1 | 106.111 |
| 269.1 | 170.062 |
| 294.062 | 178.111 |
| 294.062 | 214.049 |
| 294.062 | 250.062 |
| Group 6 | |
| 662.985 | 264.062 |
| 662.985 | 372.84 |
| 662.985 | 635.889 |
| 623.872 | 126.938 |
| 623.872 | 344.889 |
| 623.872 | 512.903 |
| Group 7 | |
| 1202.985 | 224.222 |
| 1202.985 | 425.396 |
| 1202.985 | 1184.951 |
| Group 5 | |
| 528.205 | 203.062 |
| 528.205 | 249.062 |
| 528.205 | 293.062 |
| 531.285 | 82.174 |
| 531.285 | 244.062 |
| 531.285 | 489.236 |
| 602.22 | 468.06 |
| 602.22 | 510.444 |
| 602.22 | 546.028 |
| 625.955 | 127.111 |
| 625.955 | 217.951 |
| 625.955 | 372.84 |
| Group 8 | |
| 307.162 | 117.049 |
| 307.162 | 161.062 |
| 307.162 | 250.174 |
| 321.062 | 152.111 |
| 321.062 | 194.049 |
| 321.062 | 257.062 |
| 329.062 | 77.986 |
| 329.062 | 205 |
| 329.062 | 285 |

Figure 4:
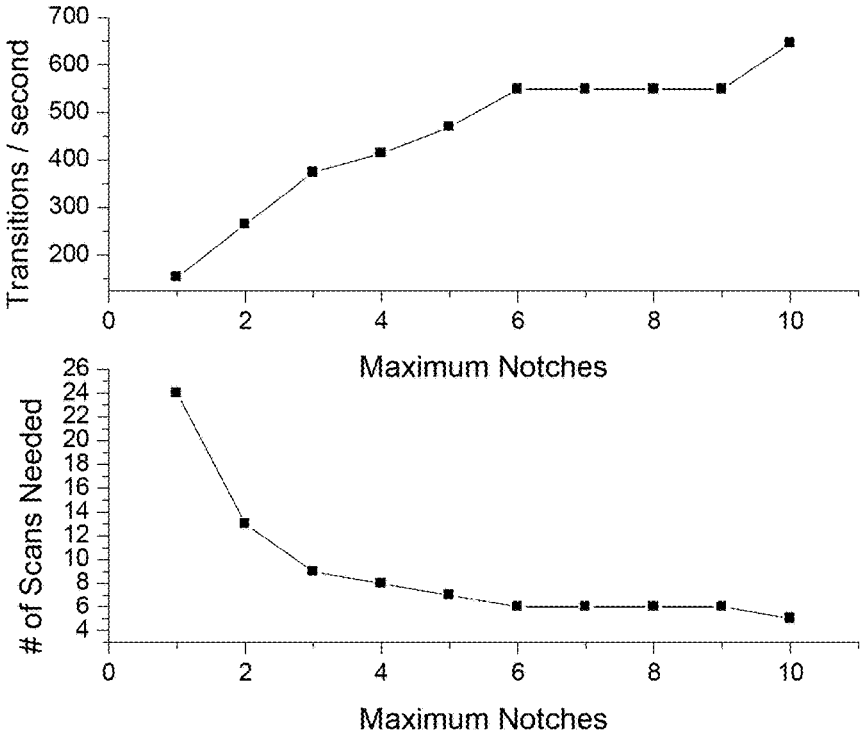
FIG. 4 is a graph showing the effects of grouping transitions, in accordance with various embodiments.

FIG. 4 is a graph showing the effect of the maximum number of precursors per group. The metric of effective transitions per second (given an analysis scan rate of 66 kDa/s, and assuming an overhead of 20 ms) and total number of scans required to acquire all the transitions are plotted as a function of the number of multiplexed isolation windows. The data make it clear that even with single precursor isolation, the 84 transitions can be grouped into just 24 scans. By multiplexing just one more precursor (N=2), the number of required scans is nearly halved. The rate of diminishing returns for transitions/second is met at about 3 precursors per group, however increasing N always increases the sampling efficiency, and thus is desirable as long as the analysis is of sufficient specificity and efficiency to be useful. These data suggest that a QIT can rival, or even exceed the transitions per second metric of the state-of-the-art triple quadrupole mass spectrometers, while increasing the sampling efficiency and hence sensitivity of the assay.

Figure 5:
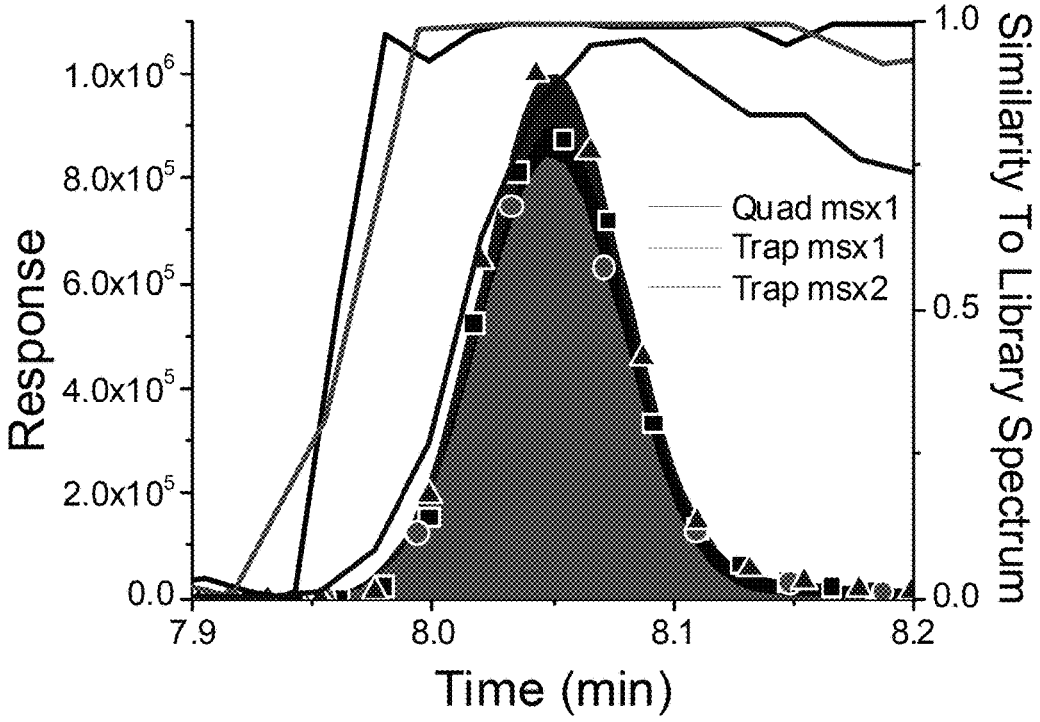
FIG. 5 is a comparison of liquid chromatography peaks of the pesticide cycluron, produced by resonance CID with 1× isolation via quadrupole mass filter or quadrupole ion trap, and 2× multiplexing via trap isolation. Solid lines are similarity of the spectra to the library spectra.
Figure 6:
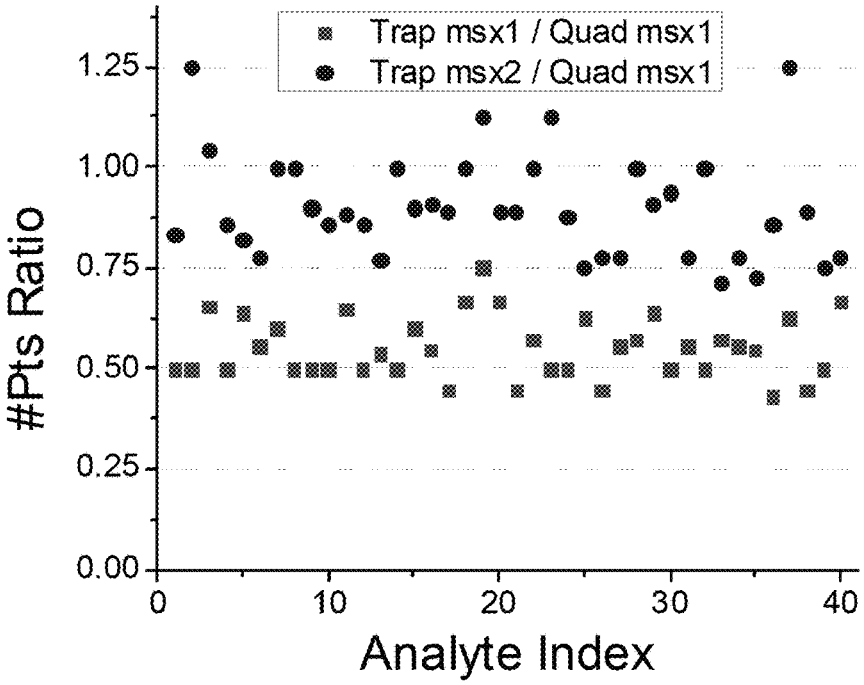
FIG. 6 is a graph showing the ratio of number of points across the liquid chromatography peaks for 1× and 2× ion trap isolation compared to 1× quadrupole isolation.
Figure 7:
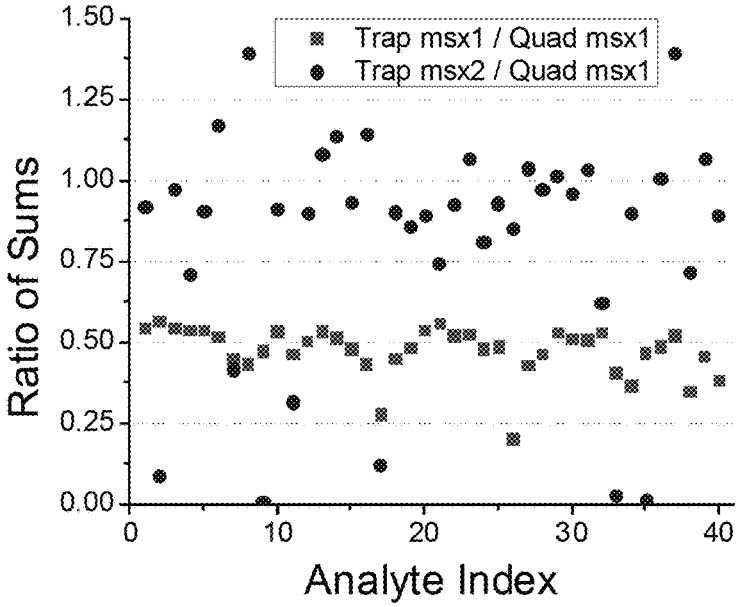
FIG. 7 is a graph showing the ratio of responses summed over liquid chromatography peak for 1× and 2× ion trap isolation, compared to 1× quadrupole isolation.

FIGS. 5, 6, and 7 show a comparison of single compound quadrupole mass filter isolation to single and double compound multiplexed ion trap isolation. Resonance CID is performed on a pesticide sample, with a maximum injection time 20 ms. In total, 40 precursors are targeted. For most multiplexed groups, the integrated liquid chromatography peaks are comparable to the non-multiplexed liquid chromatography peaks. The 2× trap multiplexing yields almost the same number of points across the liquid chromatography peaks as the 1× quadrupole isolation. The 1× trap isolation is about twice as slow. All three techniques gave comparable integrated liquid chromatography peak areas. However the sum of responses over the liquid chromatography peak was twice as small for 1× trap isolation due to the fewer number of points acquired.

What is claimed is:

1. A method for analyzing a sample, comprising:
identifying a plurality of precursors for analysis;
grouping the precursors into two or more groups, such that the precursors within a group conform to at least the following criteria:
a) masses of ions of the precursors in the group are within a first mass range;
b) masses of product ions of the precursors in the group are within a second mass range;
c) the number of precursors within the group is below a maximum allowable number of precursors; and
d) each precursor within the group has at least one unique product ion that differs from the product ions of all the other precursors within the group;
generating ions from the sample;
isolating precursor ions of a group;
fragmenting the ions of the group;
determining the mass-to-charge ratio of the fragment ions;
repeating the isolating, fragmenting, and determining steps for additional groups;
identifying or quantifying the presence of one or more precursors within the sample based on the presence of fragmented ions having a mass-to-charge ratio corresponding to the unique product ion for the precursor.

2. The method of claim 1, wherein the ions of the group are fragmented substantially simultaneously.

3. The method of claim 1, wherein the ions of the group are fragmented sequentially.

4. The method of claim 1, wherein the precursors are grouped according to an additional criterion that the optimum fragmentation energies for the precursors within the group are within a fragmentation energy range.

5. The method of claim 1, wherein identifying the plurality of precursors includes performing a survey scan to identifying ions within the sample.

6. The method of claim 1, wherein isolating the precursor ions includes isolating the precursor ions using a quadrupole ion trap, a quadrupole mass filter, or an ion cyclotron resonance device.

7. The method of claim 6, wherein isolating the precursor ions includes applying a multi-notch isolation waveform.

8. The method of claim 1, further comprising separating components of the sample by chromatography prior to generating ions; and wherein the precursors are grouped according to an additional criterion that the retention time for the precursors within the group are within a precursor time range.

9. The method of claim 1, wherein the precursors are grouped according to an additional criterion that the intensity of the precursor ions is within an intensity factor range.

10. A mass spectrometer comprising:
an ion source;
a radio frequency ion trap;
a fragmentation cell;
a mass analyzer;
and
a controller configured to:
identify a plurality of precursors for analysis;
group the precursors into two or more groups, such that the precursors within a group conform to at least the following criteria:
a) masses of ions of the precursors in the group are within a first mass range;
b) masses of product ions of the precursors in the group are within a second mass range;
c) the number of precursors within the group is below a maximum allowable number of precursors; and
d) each precursor within the group has at least one unique product ion that differs from the product ions of all the other precursors within the group;
generate ions from the sample using the ion source;
isolate precursor ions of a group using the radio frequency ion trap;
fragment the ions of the group by subjecting the ions within the fragmentation cell to a fragmentation energy;
determine the mass-to-charge ratio of the fragment ions;
repeat the isolate, fragment, and determine steps for additional groups;
identify or quantify the presence of one or more precursors within the sample based on the presence of fragmented ions having a mass-to-charge ratio corresponding to the unique product ion for the precursor.

11. The mass spectrometer of claim 10, wherein the ions of the group are fragmented substantially simultaneously.

12. The mass spectrometer of claim 10, wherein the controlled is configured to group the precursors according to at least one additional criterion selected from the group consisting of:
1) the retention time for the precursors within the group are within a precursor time range;
2) the intensity of the precursor ions is within an intensity factor range; and
3) the optimum fragmentation energies for the precursors within the group are within an energy range.

13. The mass spectrometer of claim 10, wherein the controller is configured to identify the plurality of precursors using a survey scan to identifying ions within the sample.

14. The mass spectrometer of claim 10, wherein the radio frequency ion trap is a quadrupole ion trap.

15. The mass spectrometer of claim 14, wherein the controller is configured to cause a multi-notch isolation waveform to be apply to the quadrupole ion trap to isolate the precursor ions.

* * * * *